United States Patent [19]

Berlin et al.

[11] Patent Number: 4,715,791

[45] Date of Patent: Dec. 29, 1987

[54] METERING PUMP

[75] Inventors: Bo Berlin, Staffanstorp; Gert Nedstedt, Eslöv, both of Sweden

[73] Assignee: Tetra Pak International AB, Lund, Sweden

[21] Appl. No.: 897,251

[22] Filed: Aug. 18, 1986

[30] Foreign Application Priority Data

Aug. 21, 1985 [SE] Sweden ..... 8503891

[51] Int. Cl.[4] ..... F04B 5/00; F04B 49/00

[52] U.S. Cl. ..... 417/274; 417/568

[58] Field of Search ..... 417/274, 568, 487, 488; 92/60.5

[56] References Cited

U.S. PATENT DOCUMENTS

| | | | |
|---|---|---|---|
| 957,451 | 5/1910 | Willet . | |
| 1,656,911 | 1/1928 | Eisenhauer . | |
| 2,619,907 | 12/1952 | Paterson | 417/488 |
| 2,916,998 | 12/1959 | Miller | 417/568 |
| 3,461,805 | 8/1969 | Karkow | 417/568 |
| 3,938,425 | 2/1976 | Kroffke | 417/274 |
| 4,568,249 | 2/1986 | Todd | 417/568 |

FOREIGN PATENT DOCUMENTS

| | | | |
|---|---|---|---|
| 546343 | 2/1932 | Fed. Rep. of Germany | 417/488 |
| 2151715 | 4/1973 | Fed. Rep. of Germany | 417/488 |
| 39725 | 11/1971 | Japan | 417/274 |
| 574049 | 3/1976 | Switzerland . | |
| 850556 | 10/1960 | United Kingdom | 417/568 |

*Primary Examiner*—William L. Freeh

*Attorney, Agent, or Firm*—Burns, Doane, Swecker & Mathis

[57] ABSTRACT

An arrangement for the volume-controlled feed of a medium, e.g. a liquid, in an outer flow system, comprising a movable pump piston (10) and a metering chamber (20) in connection, or connectable, to the flow system via a valve-controlled inlet (22) and outlet (23) for the intake and discharge respectively of the medium in time with the working cycles of the pump piston (10). To make possible the change between different desired feed volumes of the medium the arrangement has a wall element (15) delimiting the volume of the metering chamber (20) which is movable inside the metering chamber (20) for the adjustment of the desired metering chamber volume.

5 Claims, 2 Drawing Figures

METERING PUMP

FIELD OF THE INVENTION

The invention relates to metering pumps and more particularly to a metering pump for the flow-controlled feed of a medium from a source to a place of application of any kind in a flow system for the medium.

BACKGROUND OF THE INVENTION

Arrangements or metering pumps of the type described above have been known for a long time back and are used frequently in situations where media are to be conveyed in defined doses or flow rates for one purpose or another. This may refer to liquids, e.g. reagent solutions in connection with a chemical analysis process or a larger-scale industrial process which requires continuous supply of starting material at a correctly weighed out flow rate in order to achieve the optimum quality characteristics of a desired product, but situations also occur where gases or outright solid materials in finely divided fluid form are to be fed in volume-controlled portions according to some required working scheme.

As indicated already the field of application for the known metering pumps is highly diversified both with regard to the types of media which are to be metered and the required size of the feed doses and flow rates respectively. The respective types of application have in common, though, that the metering pump used should fulfil at least a certain degree of accuracy of performance, so that the quantity of the particular medium actually fed corresponds as closely as possible to the quantity desired on the occasion. It happens frequently, though, that it is desirable, or necessary, to adapt the quantity of feed to a varying consumption requirement, so that, for example, during a certain period a large quantity of the medium has to be fed, whilst during a subsequent period a smaller quantity may be sufficient. To make possible such an adjustment or change-over between different desired doses or flow rates in a flexible manner, it is necessary consequently for the metering pump used to possess a corresponding flexibility of capacity. On certain known metering pumps of the type described with movable pump piston such a facility to change over between different desired metering volumes or flow rates has been made possible in that the driving arrangement or the motor which is used for driving the pump piston has been provided with some type of controllable power transmission arrangement to allow increase or decrease of the stroke frequency of the pump piston, as required. This type of variable metering pumps or, more precisely, this arrangement controlling the transmission, which is required in order to drive the pump piston at the desired rates, for obvious reasons, is greatly subject to wear and requires frequently recurring inspection and maintenance, especially if the metering pump is to be used in contexts demanding frequent changes between different metering volumes and which consequently put particularly severe loads on sensitive driving components for the pump piston.

Known adustable metering pumps of a type somewhat more reliable in operation and simpler are those which operate at one and the same stroke frequency of the pump piston for the different metering volumes desired and which therefore do not require any supplementary, sensitive driving equipment of the type described just now. In the latter type of known metering pumps the desired variations in metering volumes are achieved instead with the help of stop elements limiting the stroke length of the pump piston which may be arranged either stepwise or freely movable in the pump cylinder or metering chamber. Metering pumps of this type certainly have a simpler and therefore more easily maneuverable design than the metering pumps with changing of the stroke frequency described above, but they present, on the other hand a somewhat less reliable accuracy of performance owing, among other things, to the elements, set for a desired metering volume, being very much subject to the risk of unintended shift of their set position as a result of the pump piston repeatedly striking against them. This risk naturally can be particularly serious where metering pumps are intended to be used for the metering of very small metering volumes required, since each smallest displacement of the element in such a case may give rise to substantial fault deviations from the metering volume desired.

Against this background there is an apparent demand for a metering pump which is simple in its design and maneuverability and which requires little maintenance and which nevertheless allows flexible shifting between different metering volumes desired whilst retaining accuracy of performance, also during prolonged usage.

OBJECTS AND SUMMARY OF THE INVENTION

This demand has been met in accordance with the present invention through a metering pump which comprises a movable, preferably reciprocating pump piston and a metering or measuring chamber with valve-controlled inlet and outlet for the intake and discharge respectively of the medium which is to be metered in time with the corresponding working cycles of the pump piston.

BRIEF DESCRIPTION OF THE DRAWINGS

The metering pump in accordance with the present invention is described in greater detail with reference to the attached drawing wherein.

DETAILED DESCRIPTION OF THE PREFERRED EMBODIMENT

Figure 1:
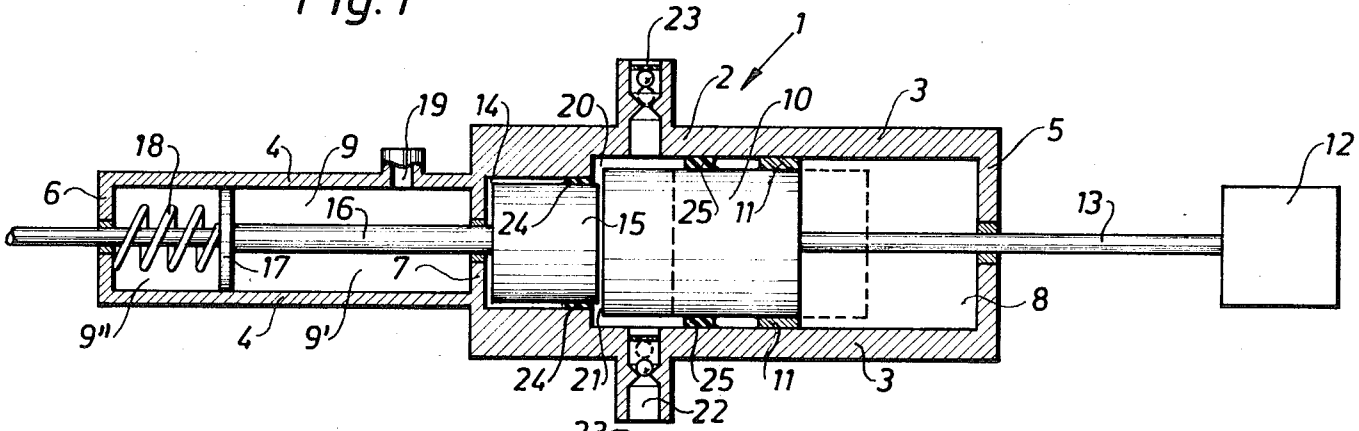
FIG. 1 is a sectional view of a simple preferred design of a metering pump in accordance with the invention.

FIG. 1 thus presents an arrangement or metering pump 1 in accordance with the present invention for the volume-controlled feed of a medium, e.g. liquid, into an outer flow system for the medium. The metering pump 1 comprises an elongated cylindrical casing body 2 with side walls 3 and 4 and end walls 5 and 6 which jointly enclose an inner cylinder chamber which with the help of a partition 7 is divided into a pump chamber 8 and a driving chamber 9. In the pump chamber 8 a pump piston 10 is supported, e.g. in a guide bearing 11, for an axially reciprocating movement between a front end position and a rear one indicated by broken lines. The pump piston 10 is driven with the help of a motor 12 and a driving shaft 13 supported in displaceable manner in the rear end wall 5.

As is evident from FIG. 1, the pump chamber 8 comprises a front space 14 of cylindrical shape of a somewhat smaller diameter than the rest of the pump chamber so as to form a seat for a cylindrical body 15 which is displaceable in the direction of movement of the pump piston 10 in the pump chamber 8 as will be explained. The cylindrical body 15 is arranged at one end of a guide rod 16 supported in displaceable manner in the driving chamber 9 by the partition 7 and the front end wall 6. Around the guide rode 16 in the driving chamber 9 is provided a slidable sealing plate 17, which is sealed off against the inside walls of the driving chamber 9 and which divides the driving chamber 9 into a rear expansion chamber 9′ and a front spring chamber 9″. A spring element 18 with seats against the front end wall 6 and the sealing plate 17 is arranged around the guide rod 16 in the spring chamber 9″ for pressing the cylindrical body 15, rigidly connected to the sealing plate 17 via the guide rod 16, in the direction against the pump piston 10 in the pump chamber 8. The expansion chamber 9′ is capable of communicating with a source (not shown) of pressure medium, e.g. air, via an inlet duct 19 provided in the side wall 4 of the casing body 2 to make possible the displacement of the cylindrical body 15 against the effect of the force of pressure of the spring element 18 against the sealing plate 17. A volume of the metering chamber 20 determining the metered medium between the cylindrical body 15 and a front surface 21 of the pump piston 10 can communicate with the outer flow system for the medium via a valve-controlled (e.g. a check valve of the ball-type) inlet 22 and outlet 23 so as to make possible a metered flow of the medium in time with the pumping cycles of the pump piston 10. To prevent any leakage from the metering chamber 20, gaskets 24 and 25 are provided in the cylindrical space 14 between the cylindrical body 15 and the inside wall of this space, and in the pump chamber 8 between the pump piston 10 and inside wall of the chamber 8 respectively.

When the arrangement shown in FIG. 1 is to be used for the feed at a maximum flow rate of, for example, a liquid into the flow system, the cylindrical body 15 is shifted to its most retracted position in the space 14, so as to obtain the greatest possible volume of the metering chamber 20 between the cylindrical body 15 and the front surface 21 of the pump piston in its rear end position (as shown by broken lines in FIG. 1). This means, therefore, that the pressure of the medium which flows into the expansion chamber 9′ from the pressure source (not shown) via the connection duct 19 must be at least equal to, preferably greater than, the spring pressure from the element 18, so as to retain the sealing plate and the cylindrical body 15, rigidly connected therewith via the guide rod 16, in the position shown in FIG. 1. With the cylindrical body 15 in this position the metering pump 1 operates in principle, in the same manner as the similar, known arrangements of piston type, that is to say, during the intake stroke or movement backwards into the pump chamber 8 of the pump piston 10 with the help of the motor 12 and the driving shaft 13 the outlet 23 is shut whilst the inlet 22 is opened for the inflow of liquid into the metering chamber 20 until the pump piston has reached its rear end position. When the pump piston thereafter turns and is driven forwards, the inlet 22 is shut whilst the outlet 23 is opened for the discharge of the liquid from the metering chamber 20.

Figure 2:
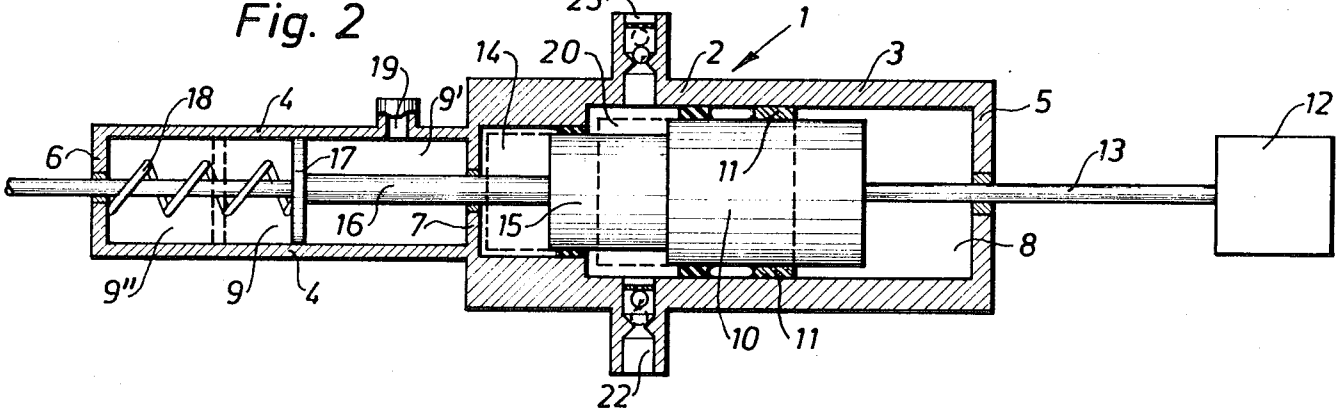
FIG. 2 is a sectional view of the same metering pump as FIG. 1, but in the case of an application with reduced volume.

When the metering pump in FIG. 1 on a later occasion is to be used for the feed of, for example, a minimum flow rate of the liquid, a procedure is adopted which is made evident best from FIG. 2. For the sake of greater clarity the same reference designations have been used in both figures for identical components. This means, therefore, that the pressure in the expansion chamber 9′ is lowered through outflow of pressure medium from the chamber 9 until the pressure in this chamber is lower than the contact pressure of the spring element 18 against the sealing plate 17. As a result the sealing plate 17 will be shifted backwards (to the right in FIG. 2) so as to press the cylindrical body 15, rigidly connected therewith via the guide rod 16, against the front surface 21 of the pump piston 10, as shown by the fully drawn lines in FIG. 2. Thus the cylindrical body 15, resting against this surface 21 on the pump piston 10, will follow the reciprocating working cycles of the pump piston in the pump chamber, when the motor 12 is started. In other words, the cylindrical body 15 and the pump piston 10 will move as a unit in the direction with the spring force from the element 18 during the intake movement of the pump piston 10 (towards the right to the end position shown in FIG. 2), whilst the same unit is displaced against this force during the pumping movement of the piston towards the left to the end position indicated by broken lines. The volume of liquid which in this manner will be sucked into the metering chamber 20 through the valve-controlled inlet 22, when the pump piston 10 together with the cylindrical body 15 move towards the rear end position and which thereafter will be discharged via the valve-controlled outlet 23, when in corresponding manner the pump piston 10 and the cylindrical body 15 move towards the left end position, corresponds to the maximum volume discharged in accordance with FIG. 1 minus the volume of the maximum part of the cylindrical body 15 introduced into the metering chamber 20 (FIG. 2).

While this invention has been illustrated and described in accordance with a preferred embodiment, it is recognized that variations and changes may be made therein without departing from the invention as set forth in the claims.

What is claimed is:

1. In an arrangement for the flow controlled feed of a medium into an outer flow system, having a movable pump piston and a metering chamber connectable to the flow system via a valve controlled inlet and outlet for the intake and discharge respectively of the medium in time with the working cycles of the pump piston, the improvement comprising a cylinder body delimiting the metering chamber and being displaceable in the metering chamber to make possible a variation in volume of this chamber, said cylinder body being loaded by a spring which endeavors to displace the cylinder body into the metering chamber towards a front surface of the pump piston and being connected to a rod which is displaceable in a casing with end walls and a side wall and in which is supported a sealing plate serving as a sliding piston, one side of said sealing plate being loaded by the spring for displacement of the cylinder body into the metering chamber and the other side of said sealing plate forming a movable end wall for a chamber which through an inlet duct is connectable to an outer source for pressure medium for inflow of this medium into the chamber for the return-movement of the sealing plate and the pump piston connected therewith via the rod from the metering chamber.

2. A metering pump for liquid comprising:

an elongated cylindrical pump body having a cylindrical pump chamber and a cylindrical driving chamber;

a pump piston in said pump chamber;

motor means for causing reciprocating axial movement of said pump piston in said pump chamber;

an inlet check valve providing flow into said pump chamber in response to reduced pressure in said pump chamber and an outlet check valve providing flow out of said pump chamber in response to increased pressure in said pump chamber, said valves cooperating to control the flow of liquid into or out of said pump chamber upon reciprocating movement of said pump piston;

a cylinder body mounted in said pump body for reciprocating axial movement in said pump chamber, said cylinder body being in substantial alignment with said pump piston; and said pump body including seal means engaging said cylinder body, a guide rod secured to said cylinder body and axially aligned with said cylinder body, a sealing plate secured on said guide rod in said driving chamber, a spring in said driving chamber engaging said sealing plate and biasing said guide rod toward said pump piston, and a port communicating with said driving chamber between said cylinder body and said sealing plate for urging said cylinder body away from said pump piston upon supplying a fluid under pressure medium to said driving chamber.

3. The metering pump according to claim 2 wherein said cylinder body has a smaller diameter than said pump piston.

4. The metering pump according to claim 2 wherein said spring is compressed between said sealing plate and the end wall of said pump body.

5. A metering pump for liquid comprising:

an elongated cylindrical pump body having a first cylinder and a second cylinder in axial alignment, said first cylinder having a larger diameter than said second cylinder;

a pump piston in said first cylinder;

a metering piston in said second cylinder;

a first seal ring in said first cylinder engaging said pump piston and a second seal ring in said second cylinder engaging said metering piston, said seal rings defining a pump chamber between said rings;

an inlet valve and an outlet valve communicating with said pump chamber;

a driving chamber on said pump body adjacent said second cylinder, a guide rod secured on said metering piston and extending through said driving chamber, said driving chamber being in the form of a cylinder, a driving piston on said guide rod in said driving chamber, and a fluid port communicating with said driving chamber between said driving piston and said second cylinder; and spring means for continuously urging said metering piston toward said pump piston, whereby when fluid pressure is increased in said driving chamber, the force of the spring means is overcome and the metering piston is displaced from said pump piston to increase the pump capacity.

* * * * *